US006446519B1

(12) United States Patent
Biester

(10) Patent No.: US 6,446,519 B1
(45) Date of Patent: Sep. 10, 2002

(54) ELECTRIC ACTUATOR

(75) Inventor: Klaus Biester, Wienhausen (DE)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/487,364

(22) Filed: Jan. 19, 2000

(30) Foreign Application Priority Data

Jan. 27, 1999 (EP) ..... 99101497

(51) Int. Cl.[7] ..... F16H 27/02

(52) U.S. Cl. ..... 74/89.15; 74/2; 74/424.82; 251/129.11; 251/69

(58) Field of Search ..... 251/68, 129.11, 251/69; 74/2, 25, 89.15, 424.82

(56) References Cited

U.S. PATENT DOCUMENTS 4,651,852 A * 3/1987 Wickham et al. ..... 192/2
4,920,881 A 5/1990 Hopper
5,046,376 A 9/1991 Baker
5,195,721 A 3/1993 Akkerman

FOREIGN PATENT DOCUMENTS

DE 3611893 A1 4/1986
GB 2266943 B 4/1991
GB 2279125 A 6/1994

* cited by examiner

*Primary Examiner*—Kevin Lee
(74) *Attorney, Agent, or Firm*—Conley, Rose & Tayon, P.C.

(57) ABSTRACT

An actuator for actuating a control mechanism by axially moving an actuating member against a force comprises a housing in which a reversible drive is arranged with a first rotatable part and a second rotatable part engagable with one another and acting on the actuating member for axially moving it in feed direction to the control mechanism upon rotation in one direction. An electric motor rotates the first rotatable part and the second rotatable part by engagement with the first rotatable part. A rotation prevention member prevents rotation of at least one of the rotatable parts in a second direction. A release releases the rotation prevention member to permit rotation of at least one of the rotatable parts to permit the actuating member to be axially moved in a direction opposite to the feed direction.

48 Claims, 3 Drawing Sheets

ELECTRIC ACTUATOR

RELATED APPLICATIONS

This application claims the benefit of European patent application No. 99101497.8 filed Jan. 27, 1999, hereby incorporated herein by reference.

BACKGROUND OF THE INVENTION

This invention relates generally to electrically powered actuators for actuating control mechanisms as valves, chokes or other control mechanisms used in particular for sub-sea oil or gas production systems. Of course such an actuator could also be used in any terrestrial remote or inaccessible location.

U.S. Pat. No. 5,195,721 discloses a fail-safe valve actuator which moves a closure member of the valve between two positions. A separate spring member is arranged for urging the second drive part in a direction to move a closure member to a second position wherein an electrically powered member prevents a first drive part from rotating in an opposite direction and thus holds the closure member in its first position. In response to the loss of the supply of electrical power to the rotating prevention member, the closure member is moved by the spring member to its other position. The rotation preventing means comprises a number of sleeves, gears and pinions and also an electric motor connected by the sleeves, gears and pinions to the drive parts.

For releasing the rotation preventing means, a disc is lifted by a compressed spring and by de-energizing a solenoid, a threaded member is no longer in engagement with a groove in one of the sleeves and a wrapped spring is correspondingly no longer tightened around the sleeves, so that one of the sleeves may be rotated with respect to the other whereby the two driving parts can move relative to one another.

Accordingly, the valve actuator of U.S. Pat. No. 5,195,721 is of a quite complicated construction with a plurality of parts wherein a separate spring must be provided for forcing the rotatable part back in position and whereby the rotation preventing means uses the electric motor in its turned-off mode to create a torque and transmit same to the actuating member to prevent any rotation thereof.

SUMMARY OF THE INVENTION

For actuating the control mechanism, an actuating member of the actuator is axially moved and in one position, the control mechanism is, for example, switched on and in another position of the actuating member is switched off. Such actuators are arranged within a housing to protect the device against outer influences at the corresponding terrestrial or aquatic location. Within the housing, an electric motor is arranged for rotating a first rotatable part and a second rotatable part both in engagement with one another. The two rotatable parts form a reversible drive for axially moving the actuating member in a feed direction to the control mechanism for operating it. In its operating position the actuating member is locked by a rotation prevention member and for unlocking the actuating member, a release is provided that permits an axial movement of the actuating member in a direction opposite to the feed direction.

It is, therefore, an object of the invention to provide an actuator of simple construction reliably preventing rotation of the actuating member without loading the electric motor with a torque for preventing such rotation.

This object is solved by an actuator of know construction characterised in that the force acting on the actuating member is externally applied by the control mechanism and the rotation prevention member is arranged between the second rotatable part and the housing to rotationally fix the rotatable part to the housing to prevent rotation in the second direction.

As the force acting on the actuating member is externally applied by the control mechanism, no additional spring or other device arranged within the actuator is needed. Correspondingly, the construction of the actuator is simplified. To hold the actuating member in position where the control mechanism is actuated, it is no longer necessary to use the electric motor and a torque supplied by it in case it is switched-off, but instead the rotation prevention member is supported by the housing to provide a torque in opposite direction to the torque supplied by the force of the control mechanism acting on the actuating member.

A simple embodiment of the reversible drive comprises an internally threaded screw nut as the first rotatable part and an externally threaded screw stem as the second rotatable part.

To lower friction between screw and stem, the screw nut and screw stem may form a ball screwing device with balls therebetween. In such a case it is also possible to use a high speed, low torque motor as the electric motor.

The housing of the actuator can be such that the electric motor is arranged within the housing and in particular at one end thereof opposite to the control mechanism. In such a way the actuator is compact and can be easily handled.

For fixing the electric motor in a simple manner within the housing, it may be fixed to a sleeve-like head member with a longitudinal boring which itself is fixed to the housing. Besides the rotational force transmitting member, a gear box may be arranged between the transmitting member and the electric motor.

A rotational force transmitting member of simple construction is a sleeve in which one end of the ball screw stem is inserted wherein the other end of the ball screw stem extends from the ball screw nut in direction to the actuating member.

As the rotational force transmitting member connects the ball screw nut and the electric motor, the sleeve may be rotationally fixed to the ball screw nut to transmit any rotation of the motor to the nut. The connection between the sleeve and the ball screw nut may be in any way that allows a rigid attachment.

The sleeve may have a closed end at which it is connected to the electric motor or the gear box. It may further have an open end portion protruding from the head member in which the ball screw nut is inserted.

To prevent rotation of the sleeve with respect to the head member in a simple way at least in that direction used for moving the actuating member in direction to the control mechanism, the sleeve may be rotatable with respect to the head member in one direction and rotatably fixed to the head member in the other direction.

This may be realised by a rotation prevention member arranged between the end portion of the sleeve and an end portion of the head member.

A rotation prevention member of simple construction is realized by end portions of the sleeve and the head member of same outer diameter with a wrapped spring as the rotation prevention member arranged at least partially on both of these end portions. This wrapped spring has no influence in case the sleeve is rotated in one direction but tightens in case it is rotated in the other direction.

For rotatably supporting and holding the sleeve in position, radial and/or thrust bearings may be arranged between the end portion of the sleeve and an inner wall of the housing.

To prevent a direct contact of sleeve and housing, a sleeve-like bushing may be arranged between these bearings and the inner wall of the housing wherein this bushing is at least rotationally fixed to the housing. It may further also be fixed to the housing in axial direction, that means in longitudinal direction of the housing or the ball screw stem.

To also rotatably support that part of the ball screw stem protruding from the ball screw nut in direction to the actuating member, a sleeve-like extension member may be fixed with respect to the housing with a boring in which that part of the ball screw stem is rotatably supported.

In one embodiment of the invention, the extension member is fixed to the bushing and may axially extend therefrom in direction to the actuating member.

According to another embodiment of the invention, a further sleeve-like end member may be arranged between the extension member and the actuating member wherein the end member is rotatably supported within the housing and the rotation prevention member is arranged between the end member and the extension member.

A rotation prevention member of simple construction may be realized by the extension member comprising an end sleeve portion with an outer diameter equal to an outer diameter of the end member and by a wrapped spring as rotation prevention member arranged at least partially on the outer surfaces of the end member and extension member.

In case end member and extension member are rotatably fixed to one another and to allow an axial displacement of the ball screw stem relative to end member and extension member, the ball screw stem is axially displaceable and rotationally fixed with respect to the end member.

A simple way to rotationally fix the ball screw stem with respect to the member is to provide a radially extending key member arranged between the ball screw stem and the end member.

This key member may protrude from an inner boring surface of the end member and may be guided in a groove extending longitudinally on an outer surface of the ball screw stem. In this way the ball screw stem and end member are rotationally fixed to one another and a rotation of the ball screw stem may be prevented by the rotation prevention member arranged between the end member and the extension member.

As the extension member is fixed to the bushing or directly to the housing, the end member and, correspondingly, also the ball screw stem are supported by the housing according to the rotation prevention member arranged between the end member and the extension member.

To avoid a direct contact between the ball screw stem and the actuating member, a thrust collar may be arranged between both. By this thrust collar, any relative rotation of ball screw stem and actuating member may be absorbed.

Different embodiments of the actuating member are possible but advantageous is an actuating stem as the actuating member extending in longitudinal direction of the housing and in particular coaxially with the ball screw stem.

In combination with this, the thrust collar may include two parts, one of which is fixed to an end of the ball screw stem and the other one supporting an end of the actuating stem with thrust bearings between the two parts.

The actuator may have a compact shape and may be easily handled in case the housing is tube-like. Moreover, to obtain a simple access for maintenance or the like, the housing may have to end caps fixable at both ends of the housing.

For releasing the wrapped spring as a rotation prevention member, different embodiments are possible. An embodiment of simple construction may be obtained in case the wrapped coil spring has a tang protruding at one end of the spring in essential radial direction and in case the release includes an engagement member releasably engaging the tang for pushing it in circumferential direction of the coil spring to release same and to allow rotation of the actuating stem in the second direction.

A simple and easily operable actuating member for such a tang may be a solenoid as a further part of the release with a plunger movable in direction to the tang. The plunger may directly push the tang to loosen the wrapped spring wherein this plunger is the engagement member.

It is also possible to arrange a cam member as the engagement member between the plunger and the tang which is pivotally supported between an engagement position and a release position wherein the cam member contacts and pushes the tang in engagement position and is spaced from the tang in release position. The cam member is pivoted from release position to engagement position by actuating the solenoid and driving the plunger in direction to the tang.

The cam member may have different shapes adapted for engagement with the plunger and the tang. In one embodiment of the cam member, it has the shape of a sector of a circle with one radius assigned to the tang and the other radius assigned to the plunger wherein the cam member is pivotally supported at an intersection of the two radii opposite to its circumference.

As the tang member radially outwardly extends from the coil or the extension end member, it is advantageous when the cam member is pivotally supported by a pivot axis extending in parallel and outwardly spaced with respect to the longitudinal axis of the ball screw stem or the housing.

For providing a support for the cam member, a tube-like housing may be provided extending between the thrust collar and the extension member wherein the cam member is pivotally supported in a gap provided in a peripheral surface of the tube-like housing.

The solenoid may also be arranged in the housing of the actuator. It is also possible to provide a separate housing or casing for the solenoid radially extending from and releasably fixed to the outer housing of the actuator.

To monitor the actuator and in particular any movement of the actuating stem, it may be recommendable to arrange at least one sensor for detecting the position of the actuating stem within the housing. Such a sensor may be a proximity switch or any other kind of sensor that can at least detect the two extreme end positions of the actuating stem.

As such actuators are used at remote terrestirial or aquatic locations that may be inaccessible, they should have a fail-safe function. This may be easily realized by the present actuator in that the plunger is spring-loaded in direction to the cam member for loosening the wrapped spring by pushing its tang in case of de-energized solenoid to provide such a fail-safe actuator.

To prevent any shocks within the actuator or by operating the control mechanism, an absorbing member may be arranged movable with the actuator stem.

In a simple embodiment, such an absorbing member plate-like surrounds the actuator stem and is fixed thereto.

For obtaining a general maintenance free actuator, a lubricant may be filled in the housing to be supplied to all moving parts within the housing which lubricant may be also used by the absorbing member to damp its movement together with the actuator stem.

As the actuator may be operated under different temperatures, the lubricant may have different volumes. Therefore, a compensator may be connected to the interior of the housing for receiving or supplying lubricant from or to the housing.

As the actuator may be operated under extreme environmental conditions, as for example sub-sea, it is advantageous to seal the housing with respect to these conditions. Accordingly, a number of sealing rings may be provided for at least sealing of the end caps with respect to the housing.

As the actuator may be also operated under explosive conditions, it is also advantageous when an explosion-proof electrical connector is provided in the housing for receiving voltage supply connectable to the electric motor.

Other advantageous features of this invention will be apparent to those skilled in the art from a consideration of this specification, including the attached drawings and dependent claims.

BRIEF DESCRIPTION OF THE DRAWINGS

For a detailed description of a preferred embodiment of the invention, reference will now be made to the accompanying drawings wherein.

DESCRIPTION OF PREFERRED EMBODIMENTS

Figure 1:
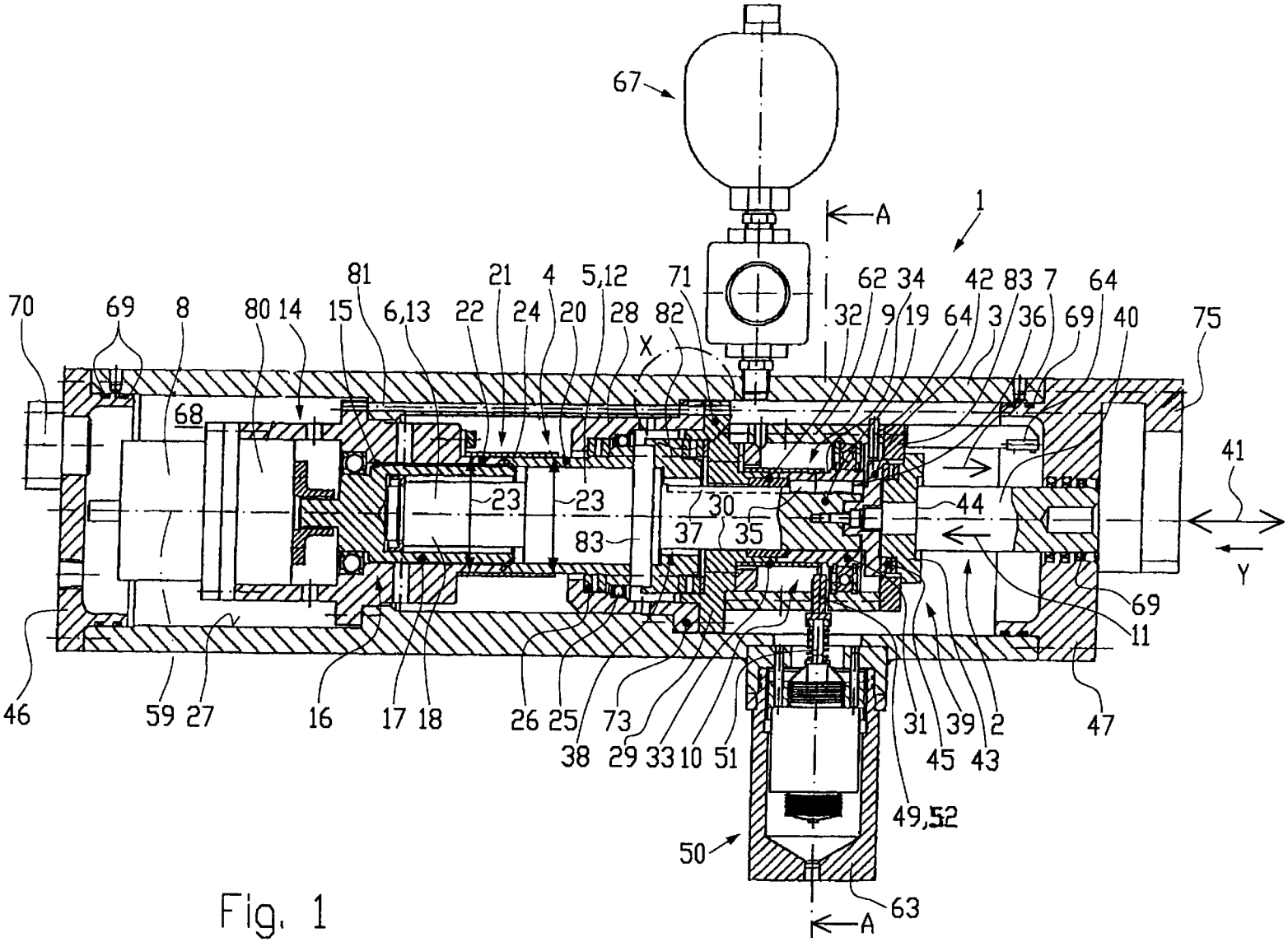
FIG. 1 is a sectional view in longitudinal direction through one embodiment of the actuator according to the invention.

Actuator 1, as shown in FIG. 1, comprises a tube-like housing 3 of circular cross section. The open ends of this housing 3 are closed by end caps 46 and 47, both having a circular flange extending in direction to the housing and inserted therein. Around the periphery of these circular flanges, sealing rings 69 are arranged.

End cap 46 is provided with a connector 70 for electrically connecting an electric motor 8 arranged within housing 3 with an external voltage supply. The connector 70 may be explosion-proof or may be a suitable certified cable entry device sealed with an O-ring.

The other end cap 47 also has a circular flange extending in a direction to the housing and inserted therein with sealing rings 69 provided on its periphery. This end cap 47 has a central opening in which an end of an actuating stem 40, as an actuating member 2, is inserted. This actuating stem 40 is movable in a feeding direction 7 and also retractable in the opposite direction 11 for operating a control mechanism (not illustrated) as a valve, choke, or the like used at remote or inaccessible terrestrial or aquatic locations.

Figure 4:
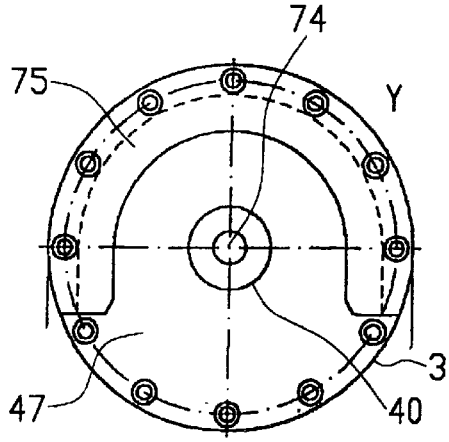
FIG. 4 is a view form direction "Y" in FIG. 1.

End cap 47 also comprises an essentially half-circular flange 75 protruding from the end cap 47 in a direction opposite to the housing for releasable fixing the control mechanism, see also FIG. 4.

Connected to the housing 3 is a compensator 67 for receiving or supplying a lubricant from or to the interior 68 of the housing. By this lubricant all moving parts within the housing are lubricated.

Electric motor 8 is fixedly connected to a head member 14 providing an chamber open in direction to the electric motor 8. In this chamber a gear box 80 is arranged for transmitting the rotational force from the electric motor 8 to a rotational force transmitting member 16. This rotational force transmitting member 16 is formed by a sleeve 17 that has one closed end which is rotatably fixed to gear box 80. The sleeve 17 is rotatably supported within a bore 15 of head member 14. An open end portion 20 of sleeve 17 protrudes from bore 15 of head member 14 in direction to actuator stem 40. The diameter of the open end portion 20 is slightly bigger than that part of sleeve 17 inserted in bore 15. Open end portion 20 and an end portion 22 of head member 14 have the same outer diameter wherein a wrapped spring 24 is at least partially arranged on the outer periphery of these portions as a rotation prevention member 21.

Inside sleeve 17, an end of screw stem 13 as a second rotatable part 6 is inserted, whereby the stem is freely rotatable with respect to sleeve 17. Within the open end portion 20, a screw nut 12 as a first rotatable part 5 is inserted rotatably fixed with respect to the open end portion 20. The screw stem 13 is inserted with its end 18 in the sleeve near its closed end wherein its other end 19 protrudes from the screw nut 12 in direction and coaxially to actuator 40.

Screw stem 13 and screw nut 12 are the first and second rotatable parts of a driving member 4 used for pushing actuator stem 40 in feeding direction 7 by a rotational force transmitted to the driving member 4 from the electric motor 8.

All the parts already mentioned as well as most of the other parts still to be mentioned are arranged along the longitudinal axis 59 of housing 3 and are symmetrical to this axis.

Open end portion 20 of sleeve 17 is inserted in an opening of a sleeve-like bushing 28 wherein radial bearings 25 and thrust bearings 26 are arranged therebetween. The bushing 28 has a radially outwardly extending flange 73 fixed to housing 3 at its inner wall 27. Adjacent to bushing 28, a sleeve-like extension member 29 is arranged and fixed together with the bushing by screwing or the like to housing 3. The extension member 29 also comprises a radially outwardly extending flange 71 in abutment with flange 73 of the bushing 28.

At least at one position along the circumference of the two flanges 73, 71, they have through holes in alignment with a lubricant supply line 81.

The extension member 29 has a bore 30 in which the other end 19 of screw stem 13 is rotatably supported. Between the extension member 29 and screw nut 12, a ring member 82 is arranged pressing a circular flange 83, extending outwardly from screw nut 12, against an end of open end portion 20. Between ring member 82 and extension member 29, further thrust bearings are arranged.

The extension member 29 has an end sleeve portion 32 extending in parallel and outside of the screw stem 13 and being in abutment with a sleeve-like end member 31.

Both have the same outer diameter wherein a wrapped spring 33 is arranged on these portions forming a rotation prevention member 9.

For rotationally fixing the other end 19 of the screw stem 13 to an inner boring surface 36 of the end member 31, a key member 35 is arranged fixed to inner bore surface 36 opposite to outer surface 34 of extension member 29 and end member 31. The key member 35 is movable along a groove 37 provided in an outer surface 38 of screw stem 13 and extending in longitudinal direction 41 or longitudinal axis 59, respectively.

Sleeve-like end member 31 is rotatably supported within a bore of a tube-like housing 62 extending from flange 71 of extension member 29 parallel and outwardly spaced from screw stem 13. Between tube-like housing 62 and end member 31, radial bearings are arranged.

At the end face of the other end 19 of the screw stem 13, a first part 42 of a thrust collar 39 is fixed by screwing. A second part 43 of the thrust collar is plate-like and rotatably supported with respect to the first part by thrust bearings 45 arranged therebetween. For radially supporting thrust collar 39, a ring 83 is provided which is fixed to the tube-like housing 62.

The second part 43 of the thrust collar 39 has a recess on its surface directed to the actuating stem 40. This is in engagement with its end 44 with this recess and correspondingly with the second part 43 of the thrust collar 39.

For sealingly guiding actuating stem 40 in end cap 47, a number of sealing rings 69 are arranged therebetween.

Opposite to compensator 67, a solenoid 50 is arranged within a casing 63 wherein this solenoid is part of release 10 for releasing wrapped spring 33 to allow a rotation of screw nut 12 in a second direction opposite to a first direction according to which actuating stem 40 is pushed in feeding direction 7.

Casing 63 is releasably fixed to the outer surface of housing 3. A plunger 51 of the solenoid 50 protrudes to the interior 68 of the housing and is in abutment with a cam member 52 as an engagement member 49. This cam member 52 is arranged between the end of the plunger 51 and the tang 48, see also FIG. 2, of the wrapped spring 33. The cam member 52 is pivotally supported in a gap 60, see again FIG. 2, of the tube-like housing 62.

Further arranged within housing 3 are two proximity switches as sensors 64 used for detecting the position of actuating stem 40 by monitoring any movement of the first part 42 of thrust collar 39. By these two proximity switches, the extreme end positions of the actuating stem 40 are detected.

Figure 2:
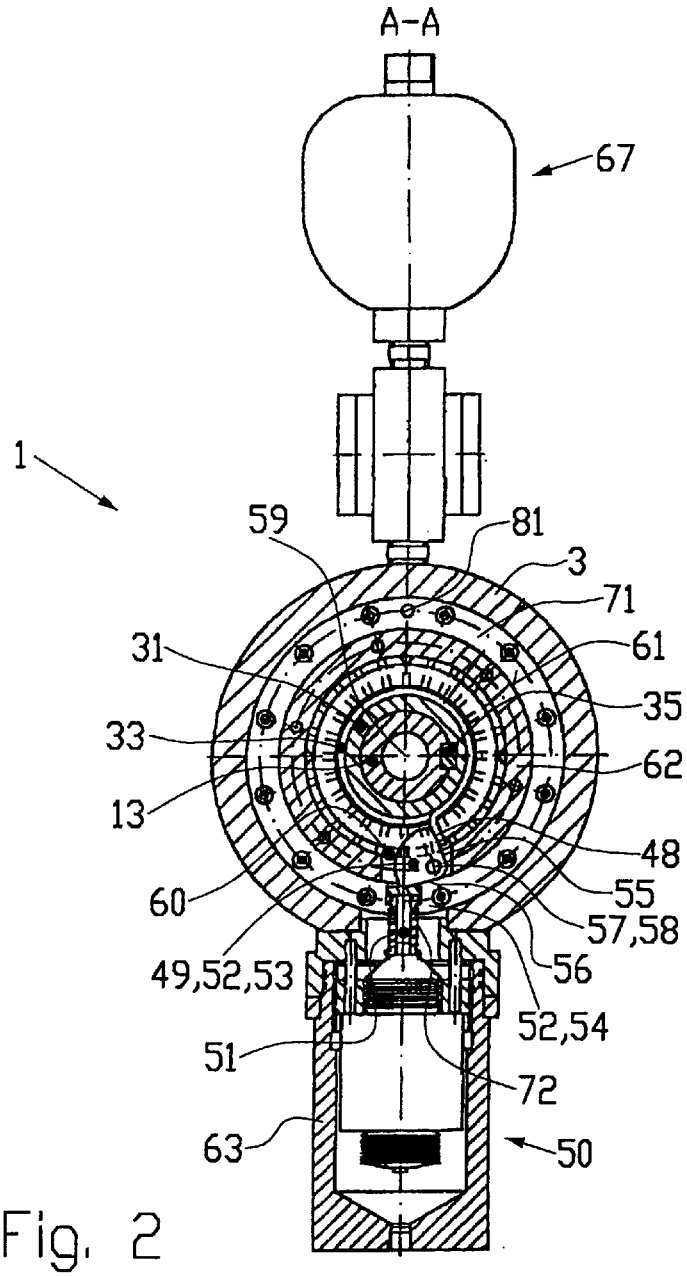
FIG. 2 is a view of the actuator taken along line A—A of FIG. 1.

In FIG. 2, a section of the actuator 1 according to FIG. 1 along line A—A is illustrated.

In this FIG. the rotational symmetrical construction of the actuator 1 and in particular of housing 3 with all of its inner parts, is apparent. As a first part within housing 3, flange 71 of extension member 29 is arranged. Then a peripheral surface 61 of tube-like housing 62 with end member 31 and screw stem 13 are illustrated, all symmetrical to longitudinal axis 59 of housing 3.

Between end member 31 and screw stem 30, key member 35 is arranged.

At one end of wrapped spring 33, tang 48 extends radially outwardly and is in abutment with one side surface of cam member 52. In FIG. 2 cam member 52 is in its engagement position 53 whereby a corresponding release position 54 is shown in dotted lines.

The cam member 52 has the shape of the sector of a circle with its two side surfaces formed by radii 55 and 56. At an intersection 57 of the two radii 55 and 56, the cam member 52 is pivotally supported about pivot axis 58 opposite to its curved circumference.

The cam member 52 is pivotally supported within the gap 60 of the tube-like housing 62.

Figure 3:
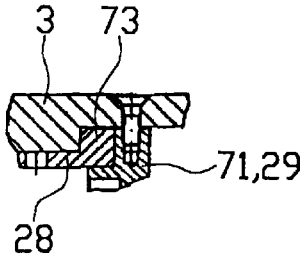
FIG. 3 is an enlarged view of detail "X" in FIG. 1.

In FIG. 3 an enlarged view of detail X from FIG. 1 is illustrated.

In this FIG. it is shown in which way flanges 71 and 73 of extension member 29 and bushing 28, respectively, are fixed to housing 3 by screwing or the like.

In FIG. 4 a view from direction Y of the actuator 1, see FIG. 1, is illustrated. Semicircular flange 75 extends along the outer periphery of housing 3 for forming a push-in element in which an end part of the control mechanism (not illustrated) may be inserted and thereafter screwed to the end surface of end cap 47.

Within the end cap 47, an opening is provided through which actuator stem 40 with its bore 74 is visible.

Figure 5:
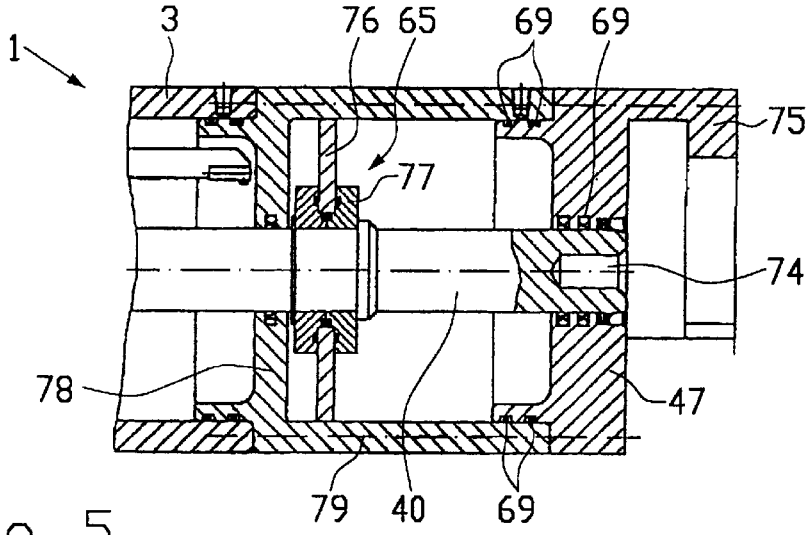
FIG. 5 is a further embodiment of the actuator according to the invention with an absorbing member arranged on an actuating stem.

In FIG. 5, another embodiment of the actuator 1 is illustrated. In this embodiment the end cap 47 is not directly fixed to housing 3. Instead, an intermediate housing 79 is arranged therebetween and fixed to housing 3 and end cap 47. Within the intermediate housing 79, an absorbing member 65 is arranged. The absorbing member 65 is arranged adjacent to an end wall 78 of the intermediate housing 79 closing housing 3 and providing a through hole through which the actuator stem 40 is guided. The absorbing member 65 is fixed to actuator stem 40 with a hub 77 by which an annular plate 76 is held. By moving the actuator stem 40 in feeding direction 7 or in the opposite direction 11, see FIG. 1, the movement of the actuator stem 40 is damped by the simultaneous movement of annular plate 76 and the displacement of any lubricant filled in the intermediate housing 79.

Figure 6:
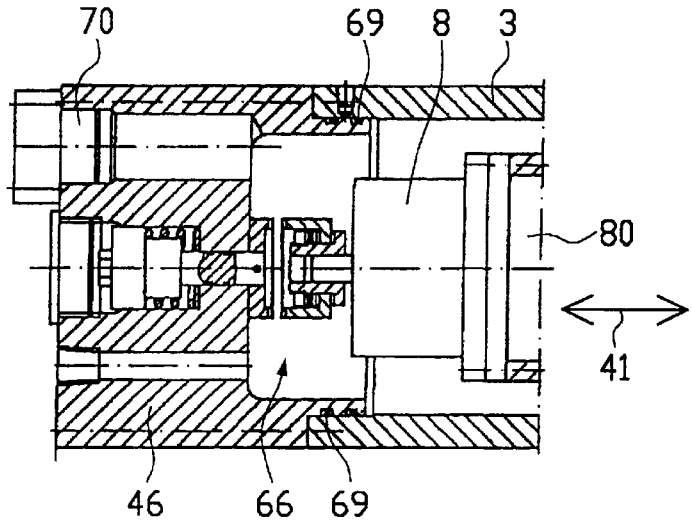
FIG. 6 is a further embodiment of the actuator according to the invention with an overdrive connectable to an electric motor.

In FIG. 6 a further embodiment of the invention is disclosed. Here, the end cap 46 has a greater length in longitudinal direction 41 compared to FIG. 1 with an additional opening in the middle of the cap. In this opening an overdrive 66 is arranged that may be brought in engagement with electric motor 8.

Similar to FIG. 1, an explosion-proof connector 70 may be provided in the end cap 46.

In the following, the working of the actuator according to the invention is briefly summarized.

Electric motor 8 is a high speed low torque motor which drives gear box 80. The motor may or may not be reversible. In one embodiment of the invention, it only drives gear box 80 in counter clockwise direction. The gear box 80 drives sleeve 17, which is attached rigidly to screw nut 12.

It should be noted that screw nut 12 and screw stem 13 may be a ball screw nut and a ball screw stem with balls arranged therebetween.

Head member 14 is rigidly attached to the outer housing 3, thus it cannot rotate. Wrapped spring 24 rotationally locks sleeve 17 to head member 14. Wrapped spring 24 is wound clockwise. This will allow sleeve 17 to rotate freely in a counter clockwise direction with respect to head member 14, which is rigidly attached to the housing 3. Spring 24, however, will not allow sleeve 17 to rotate clockwise. The rotational directions set forth above and in the following are specified by looking from the electric motor 8 downward in direction to actuator stem 40.

Since the ball nut 12 is rigidly attached to sleeve 17, it can rotate only in a counter clockwise direction. Bushing 28 and extension member 29 are rigidly attached to the housing 3, thus cannot rotate.

Ball nut 12, sleeve 17 and thrust plate or ring member 82 are secured axially and radially by bushing 28 and extension member 29. Radial and thrust bearings 25, 26 allow ball nut 12 to rotate, but to have no axial movement.

Threaded ball screw stem 13 is fixed rotationally inside end member 31 by key member 35. The longitudinal key slot or groove 37 in stem 30 allows an axial movement of the stem inside end member 31.

End member 31 is fixed rotationally to extension member 29 by the wrapped spring 33, which is wound counter clockwise. This will allow end member 31 and stem 13 to rotate freely in a clockwise direction, but locks end member 31 to extension member 29 to prevent counter clockwise rotation of the stem 13.

In operation, the electric motor 8 rotates ball nut 12 in a counter clockwise direction.

The threaded screw stem 13 is prevented from a counter clockwise rotation. The ball screw nut 12 and the threaded screw stem 13 have a right-hand thread.

Thus, a counter clockwise rotation of nut 12 tends to push the nut upward and the stem downward. Since the nut is prevented from axial motion, and the key slot 37 in stem 13 allows axial motion, the result is a downward movement of screw stem 13. This forces thrust collar 39 to push actuating stem 40 downward.

A ball screw combination, such as ball screw nut 12 and threaded screw stem 13, is extremely efficient and will overhaul (backdrive) if not restrained. Force pushing upward on actuating stem 40 will try to backdrive the ball screw-ball nut combination. In order to do this, one of two things must happen. First, the ball nut 12 must rotate clockwise, which it cannot do because of wrapped spring 24, second the threaded screw stem 13 must rotate counter clockwise, which it cannot do because of wrapped spring 33. Thus, actuator stem 40 is locked in its extended position, which opens a fail-safe valve as an example for a control mechanism.

The means for closing the valve, the release, will be described in the following.

The fail-safe valve as the control mechanism contains a strong spring, which continuously tries to close the valve by pushing actuator stem 40 upwards. Wrapped spring 33, which prevents threaded screw stem 13 from rotating counter clockwise, has the tang 48 at its bottom most coil. If this tang is pushed in a clockwise direction looking down, it will allow end member 31 and threaded screw stem 13 to rotate counter clockwise, see FIG. 2. Please note that in FIG. 2, it is a view looking upwards, not downwards. Thus, a counter clockwise rotation in FIG. 2 is a clockwise rotation in the notation according to FIG. 1, and vice versa.

Cam member 52 has a pivot axis 58 around which it may be rotated to push against tang 48. Solenoid 50 contains a spring-loaded plunger 51, which acts against cam member 52. The energized solenoid 50 holds the spring-loaded plunger away form the cam member. To close the fail-safe valve as the control mechanism, electrical power is removed from the solenoid 50. This allows the spring-loaded plunger 51 to push against cam member 52, which in turn forces this to rotate from its release position 54 to its engagement position 53. This action pushes on tang 48 which releases wrapped spring 33 and allows counter clockwise rotation of screw stem 13.

Since the ball screw will overhaul, the force of the spring in the fail-safe valve will cause counter clockwise rotation of screw stem 13 and allow the valve to close. Thrust collar 39 utilizes the thrust bearing 45 to allow rotation of screw stem 13 even though actuator stem 40 does not rotate.

It is also noted that any loss of power to solenoid 50, whether intentional or accidental, will cause the fail-safe valve as the control mechanism to close. Thus, the actuator according to the invention is truly fail-safe.

What is claimed:

1. An actuator for actuating a control mechanism applying a force against the actuator comprising:

an actuating member adapted to be axially movable against the force;

a housing having an enclosure in which a reversible drive is arranged with a first rotatable part and a second rotatable part engagable with one another and acting on said actuating member axially moving said actuating member in a feed direction relative to the control mechanism upon rotation in a first rotatable direction;

a motor rotating said first rotatable part and said second rotatable part by engagement with said first rotatable part;

a first rotation prevention member preventing a rotation of at least one of said rotatable parts in a second rotatable direction, a release releasing said first rotation prevention member to permit rotation of said at least one rotatable part to permit said actuating member to be axially moved in a direction opposite to said feed direction, and said first rotation prevention member being arranged between said second rotatable part and said housing to rotationally fix said second rotatable part to said housing to prevent rotation in said second rotatable direction.

2. The actuator according to claim 1, wherein said first rotatable part is an internally threaded screw nut and said second rotatable part is an externally threaded screw stem.

3. The actuator according to claim 2, wherein said screw nut and screw stem form a ball screwing member with balls therebetween.

4. The actuator according to claim 1, wherein said motor is arranged within said enclosure of said housing at one end thereof opposite to the control mechanism.

5. The actuator according to claim 3, wherein said motor is fixed to said housing by a head member with a longitudinal boring through which a rotational force transmitter extends rotationally connecting said screw nut with said motor.

6. The actuator according to claim 5, wherein said rotational force transmitter is a sleeve in which one end of said screw stem is inserted wherein the other end of said screw stem extends from said screw nut in the direction of said actuating member.

7. The actuator according to claim 6, wherein said sleeve is rotationally fixed to said screw nut.

8. The actuator according to claim 6, wherein an open end portion of said sleeve protrudes from said head member, wherein said screw nut is inserted therein.

9. The actuator according to claim 8, wherein said sleeve is rotatable with respect to said head member in one direction and rotatably fixed to said head member in the other direction.

10. The actuator according to claim 8, wherein a second rotation prevention member is arranged between the end portion of said sleeve and an end portion of said head member.

11. The actuator according to claim 10, wherein the end portions of said sleeve and said head member have the same outer diameter and said second rotation prevention member comprises a first wrapped spring arranged at least partially on said end portions.

12. The actuator according to claim 11, wherein radial and/or thrust bearings are arranged between said end portion of said sleeve and an inner wall of said housing.

13. The actuator according to claim 12, wherein a sleeve-like bushing is arranged between the bearings and said inner wall of the housing wherein said bushing is at least rotationally fixed to said housing.

14. The actuator according to claim 13, wherein a sleeve-like extension member is fixed with respect to said housing with a boring in which said screw stem is rotatably supported.

15. The actuator according to claim 14, wherein said extension member is fixed to said bushing and axially extends therefrom in the direction of said actuating member.

16. The actuator according to claim 14, wherein a sleeve-like end member is arranged between said extension member and said actuating member with said first rotation prevention member arranged between said end member and said extension member.

17. The actuator according to claim 16, wherein said extension member comprises an end sleeve portion with an outer diameter equal to an outer diameter of said end member and a second wrapped spring as said first rotation prevention member is arranged at least partially on said outer surfaces of the end member and extension member.

18. The actuator according to claim 16, wherein said screw stem is axially displaceable and rotationally fixed with respect to said end member.

19. The actuator according to claim 16, wherein a radially extending key is arranged between said screw stem and said end member.

20. The actuator according to claim 19, wherein said key protrudes from an inner boring surface of said end member and is guided in a groove extending longitudinally in an outer surface of the screw stem.

21. The actuator according to claim 14, wherein a thrust collar is arranged between said screw stem and said actuating member.

22. The actuator according to claim 21, wherein said actuating member is an actuating stem extending in longitudinal direction of said housing and in particular coaxially with said screw stem.

23. The actuator according to claim 22, wherein said thrust collar includes two parts one of which is fixed to an end of the screw stem and the other end supporting an end of the actuating stem with thrust bearings between the two parts.

24. The actuator according to claim 1, wherein said housing is tube-like with end caps fixable at both ends.

25. The actuator according to claim 22, wherein said second wrapped spring has a tang protruding at one end of the second wrapped spring in an essentially radial direction and said release includes an engagement member releasably engaging said tang for pushing it in a circumferential direction of the second wrapped spring to release same and to allow rotation of said actuator stem in said second direction.

26. The actuator according to claim 25, wherein said release further includes a solenoid with a plunger movable in the direction of said tang.

27. The actuator according to claim 26, wherein the engagement member is a cam member arranged between said plunger and said tang, said cam member being pivotally supported between an engagement position and a release position, wherein said cam member contacts and pushes said tang in said engagement position and is spaced from said tang in said release position.

28. The actuator according to claim 27, wherein said cam member has the shape of a sector of a circle with one radius assigned to the tang and the other radius assigned to the plunger wherein the cam member is pivotally supported at an intersection of the two radii opposite to its circumference.

29. The actuator according to claim 27, wherein said cam member is pivotally supported by a pivot axis extending in parallel and outwardly spaced with respect to a longitudinal axis of said ball screw stem.

30. The actuator according to claim 27, wherein said cam member is pivotally supported in a gap provided in a peripheral surface of the tube-like housing extending between said thrust collar and said extension member.

31. The actuator according to claim 25, wherein said solenoid is arranged in a casing radially extending from and releasably fixed to said housing.

32. The actuator according to claim 22, wherein at least one sensor for detecting a position of said actuating stem is arranged within said housing.

33. The actuator according to claim 27, wherein said plunger is spring-loaded in direction to said cam member for pushing same in the direction of said tang in case of a de-energized solenoid to provide a fail-safe function.

34. The actuator according to claim 22, wherein an absorber is arranged movably with said actuating stem.

35. The actuator according to claim 34, wherein said absorber surrounds said actuating stem and is fixed thereto.

36. The actuator according to claim 1, wherein an overdrive is connectable to the motor.

37. The actuator according to claim 1, wherein a lubricant is filled in the housing and is supplied to all moving parts within the housing.

38. The actuator according to claim 1, wherein a compensator is connected to the interior of the housing for receiving and supplying lubricant.

39. The actuator according to claim 24, wherein a number of sealing rings are provided for at least sealing the end caps with respect to the housing.

40. The actuator according to claim 1, wherein an explosion-proof electrical connector is provided in said housing for receiving a voltage supply member connectable to said motor.

41. An actuator comprising:

a housing;

an actuating member;

first and second rotatable parts disposed within said housing and engagable with one another, said rotatable parts adapted to move the actuating member axially upon rotation in one direction;

a rotating member engaging said first rotatable part and rotating said first and second rotatable parts;

a prevention member arranged between said second rotatable part and said housing to rotationally fix said second rotatable part to said housing and prevent rotation of at least one of said rotatable parts in a second direction; and a release releasing said prevention member to permit rotation of said at least one rotatable part to permit said actuating member to move axially in a direction opposite to said one direction.

42. An assembly for actuating a control mechanism providing a force comprising:

first and second rotatable members rotatably engaging such that said second rotatable member moves axially upon one of said rotatable members being rotated with respect to the other of said rotatable members;

a release member having a first position preventing said second rotatable member from rotating in a first rotating direction and a second position allowing said rotatable member to rotate in an opposite second rotating direction;

an actuator member reciprocably movable and engaging said second rotatable member;

a motor rotating said first rotatable member in said first rotating direction when said release member is in said first position causing said second rotatable member to move axially in a first axial direction, said first rotatable member being prevented from rotating in said second rotating direction; and the actuator member adapted to be axially moveable in a second axial direction against the force of the control mechanism and causing said second rotatable member to rotate in said second rotating direction and move axially in said second axial direction when said release member is in said second position.

43. An assembly for actuating a control mechanism providing a force comprising:

a screw threadingly engaging a nut such that said screw moves axially upon one of said screw and nut being rotated with respect to the other of said screw and nut;

a tang having a first position preventing said screw from rotating in a first rotating direction and a second position allowing said screw to rotate in an opposite second rotating direction;

an actuator shaft reciprocably movable and engaging said screw;

a motor rotating said nut in said first rotating direction when said tang is in said first position causing said screw to move axially in a first axial direction, said nut being prevented from rotating in said second rotating direction; and the actuator shaft adapted to be axially moveable in a second axial direction against the force of the control mechanism and causing said screw to rotate in said second rotating direction and move axially in said second axial direction when said tang is in said second position.

44. The assembly of claim 43 further including a solenoid to move said tang from said first position to said second position.

45. The assembly of claim 43 wherein said tang is part of a spring and further including a cam which moves said tang from said first position to said second position.

46. The assembly of claim 43 further including a spring which prevents said nut from rotating in said second rotating direction.

47. The assembly of claim 43 further including a sleeve mounted on said motor receiving said nut and one end of said screw.

48. The assembly of claim 43 further including a lubrication compensator lubricating the assembly.

* * * * *